US012146314B1

(12) United States Patent
Zhukovskii

(10) Patent No.: US 12,146,314 B1
(45) Date of Patent: Nov. 19, 2024

(54) METHOD FOR CONSTRUCTING A PYRAMID

(71) Applicant: Andrei Zhukovskii, Sunny Isles Beach, FL (US)

(72) Inventor: Andrei Zhukovskii, Sunny Isles Beach, FL (US)

( * ) Notice: Subject to any disclaimer, the term of this patent is extended or adjusted under 35 U.S.C. 154(b) by 199 days.

(21) Appl. No.: 17/860,184

(22) Filed: Jul. 8, 2022

(51) Int. Cl.
*E04B 1/00* (2006.01)
*E04B 1/343* (2006.01)
*E04B 1/35* (2006.01)
*E04B 1/344* (2006.01)

(52) U.S. Cl.
CPC ..... *E04B 1/3522* (2013.01); *E04B 1/34321* (2013.01); *E04B 1/344* (2013.01); *E04B 2001/3588* (2013.01)

(58) Field of Classification Search
CPC .... E04B 1/3538; E04B 1/3522; E04B 1/3527; E04B 1/34321; E04B 1/344; E04B 1/34331; E04B 2001/3588
See application file for complete search history.

(56) References Cited

U.S. PATENT DOCUMENTS 3,354,590 A * 11/1967 Gilroy ..... E04B 1/3408 52/92.1
4,645,379 A * 2/1987 Grimsley ..... B63B 35/44 D25/1
7,921,610 B2 * 4/2011 Boatwright ..... E04B 1/24 52/643
10,145,105 B2 * 12/2018 Aldino ..... E04B 7/026
10,707,807 B2 7/2020 Jacques
10,718,107 B2 7/2020 Martin
10,892,371 B2 * 1/2021 Ott ..... F24S 25/13
11,028,542 B2 * 6/2021 Raml ..... E01F 7/025
11,874,449 B2 * 1/2024 Jacques ..... H05B 45/325
2015/0159393 A1 * 6/2015 Gulik ..... E04H 9/14 109/1 S
2015/0300035 A1 * 10/2015 Morta ..... E04B 1/942 52/27
2016/0376805 A1 * 12/2016 Morta ..... E04H 1/1205 52/90.1
2018/0313105 A1 * 11/2018 Morta ..... E04B 1/34321
2018/0340327 A1 * 11/2018 Martin ..... E04H 1/00
2020/0109575 A1 * 4/2020 Morta ..... F41H 5/24

* cited by examiner

*Primary Examiner* — Chi Q Nguyen
(74) *Attorney, Agent, or Firm* — Sanchelima & Associates, P.A.; Christian Sanchelima; Jesus Sanchelima

(57) ABSTRACT

A method for constructing a pyramid including a plurality of triangular and rectangular modules, a top and lifting elements. The bottom of the top is secured to the lifting elements. The triangular and rectangular modules connect to define a first tier. The first tier being attached to the bottommost end of the top. The lifting elements lift the top to place the first tier underneath the top. Additional tiers are added by rearranging the lifting elements underneath the last tier created. The modules are preferably covered by solar panels. The lifting elements are removed after reaching a predetermined size.

16 Claims, 4 Drawing Sheets

METHOD FOR CONSTRUCTING A PYRAMID

BACKGROUND OF THE INVENTION

1. Field of the Invention

The present invention relates to a method for constructing a pyramid and, more particularly, to a method for constructing a pyramid that allows the creation of different sized pyramids.

2. Description of the Related Art

Several designs for methods for constructing have been designed in the past. None of them, however, include a set of modules which can be connected to define tiers which are connected to increase the size of the pyramid.

Applicant believes that a related reference corresponds to U.S. Pat. No. 10,707,807 issued for pyramid wall sections. Applicant believes that another related reference corresponds to U.S. Pat. No. 10,718,107 issued for a pyramidal housing autonomous and suitable for different environmental conditions. None of these references, however, teach of a method for constructing a modular size pyramid comprising installing the pyramid top and installing lifting elements underneath said pyramid top.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a method for constructing a pyramid that uses mounting elements to attach a tier to a previous level allowing to add tiers to the pyramid.

It is another object of this invention to provide a method for constructing a pyramid that includes modules that can be arranged together to create different sized tiers.

It is still another object of the present invention to provide a method for constructing a pyramid that includes lifting elements for lifting the pyramid while constructing to add tiers thereto.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
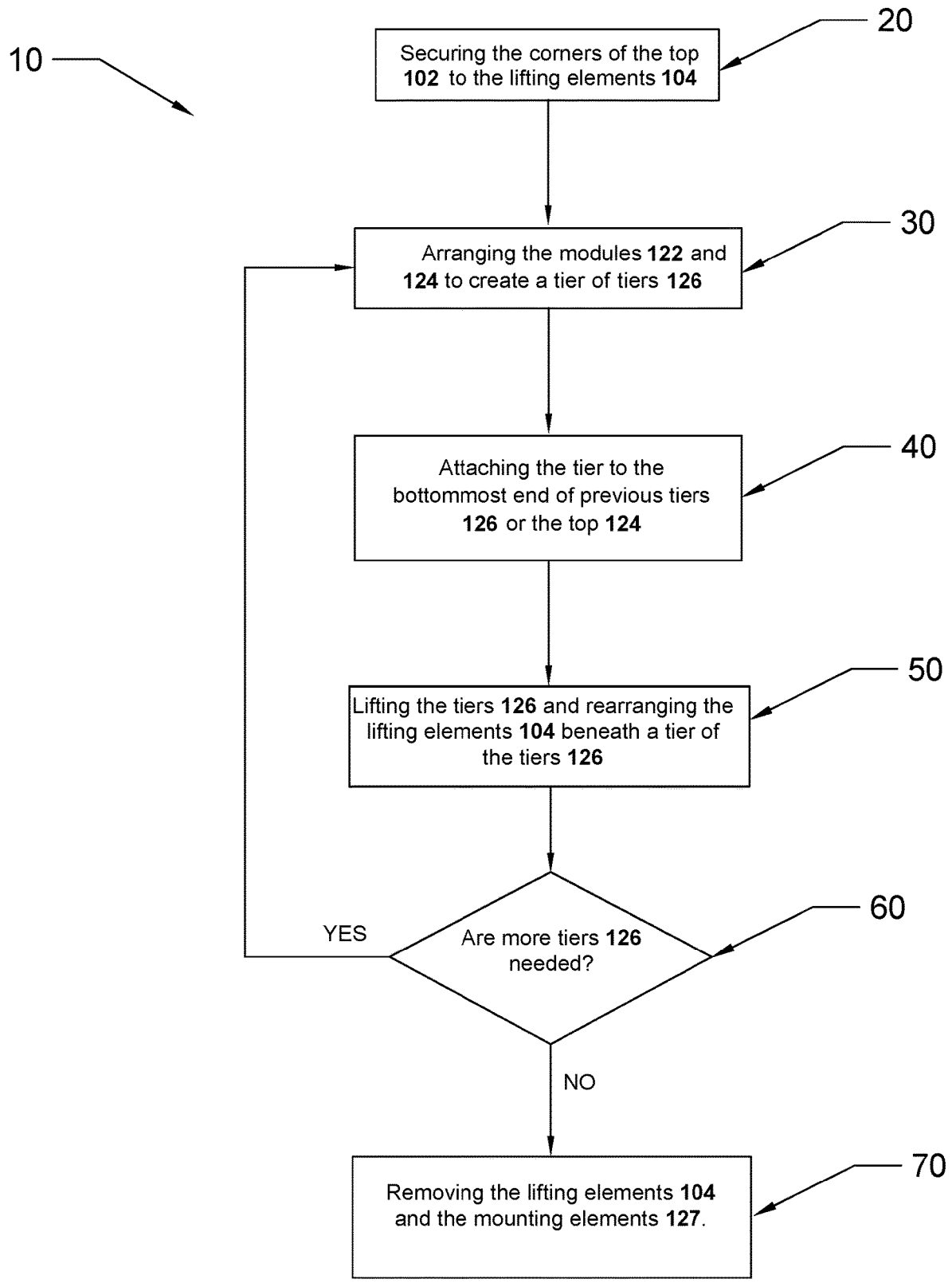
FIG. 1 represents a flow chart for method 10 containing a first step 20, a second step 30, a third step 40, a fourth step 50, a fifth step 60 and a sixth step 70.

Referring now to the drawings, where the present invention is generally referred to with numeral 10, it can be observed that it basically includes a first step 20, a second step 30, a third step 40, a fourth step 50, a fifth step 60 and a sixth step 70. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present method 10 is used to create the pyramid 100. The first step 20 may be securing the corners of the top 102 to the lifting elements 104. The lifting elements 104 may be at least one lifting element located in the bottommost end of the top 102. In a preferred embodiment the lifting elements 104 may be four lifting elements placed on each corner of the top 102 or in the corners of the tiers 126. It should be understood that the lifting elements 104 may be jacks, forklifts, cranes, or any other suitable lifting element. The lifting elements 104 may be placed in such a way that working on modifications for the pyramid 100 is feasible. The lifting elements 104 may be used to lift the top 102 or the tiers 126. The lifting elements 104 may vertically lift the top 102 or the tiers 126 a predetermined distance from a surface. In a preferred embodiment the top 102 may be a frame made of metal. It also may be suitable for the top 102 to be made of wood, plastic, or any other suitable material. The top 102 may have a square pyramid shape.

Figure 4:
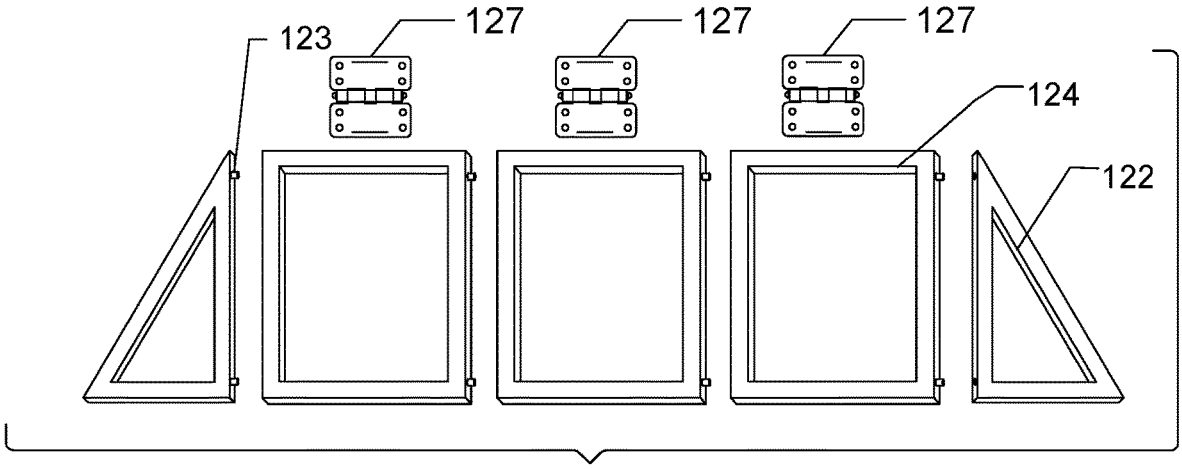
FIG. 4 is a representation of an exploded view of one of the sides of a first level of the tiers 126 including triangular modules 122 and rectangular modules 124. The triangular modules 122 and the rectangular modules 124 being connected through connecting elements 123.

The second step 130 may be arranging the modules 122 and 124 to create a tier 126. As best shown in FIG. 4 the tiers 126 may be made through arranging rectangular modules 124, triangular modules 122 and mounting elements 127. In a preferred embodiment the triangular modules 122 may be right-triangular-framed modules. It also may be suitable for the triangular modules 122 to be any triangular variation. The rectangular modules 124 may be rectangular frames made of metal. It also may be suitable for the rectangular modules 124 to be made of wood, plastic, or any other suitable material. The rectangular modules 124 may have attaching elements 123 on the sides. The attaching elements 123 may be openings, prongs, nuts and bolts, or any other suitable attaching element that allows to connect and fix the rectangular modules 124 one to the other. The attaching elements 123 may be used to connect the rectangular modules 124 and the triangular modules 122 one with the other. A plurality of rectangular modules 124 may be connected together defining a rectangular set of modules. A leg of a triangular module of the triangular modules 122 may be connected to a left side of the rectangular set of modules. A leg of another triangular module of the triangular modules 122 may be connected to the right side of the rectangular set of modules defining a face of the tier 126. The face of the tier 126 may conform with the shape of a trapezoid. In a preferred embodiment three rectangular modules 124 may be arranged together to create a first tier of the tiers 126. One more rectangular module may be added to create a second tier, two more rectangular modules 124 may be added to create a third tier. It should be understood that the first tier, the second tier or any tier may include any suitable number of rectangular modules 124. The rectangular modules 124 and the triangular modules 122 may vary in size depending on the requirements of a construction.

Figure 2:
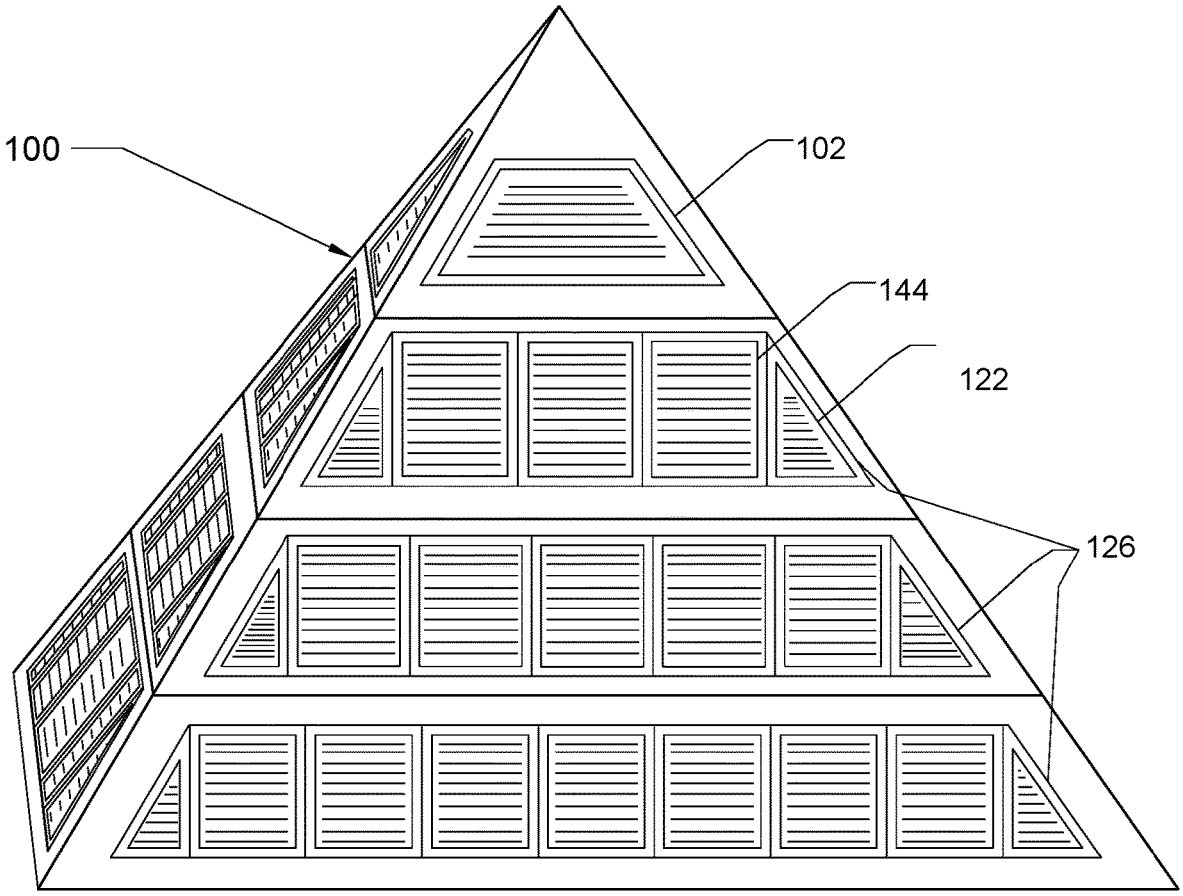
FIG. 2 shows an isometric view of the pyramid 100 having three tiers 126 and a top 102.
Figure 3:
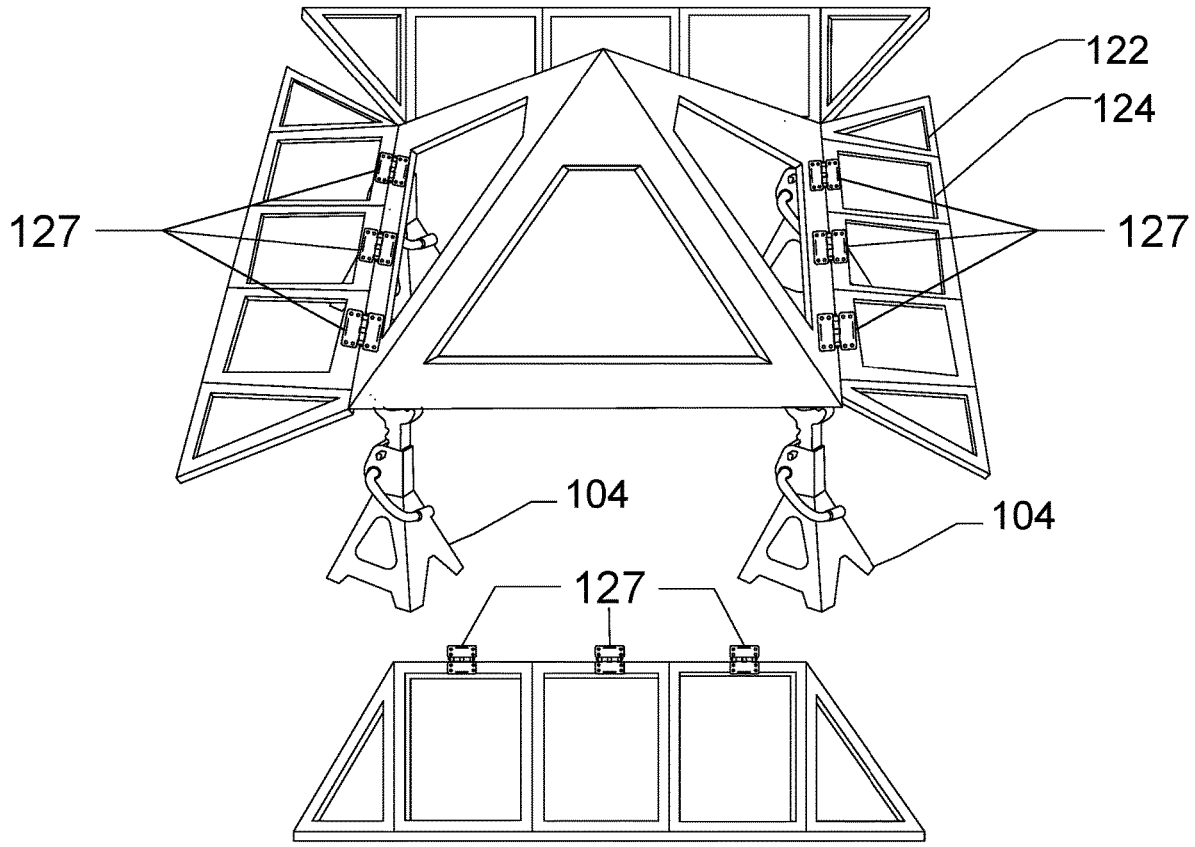
FIG. 3 illustrates an isometric view of a first level of the tiers 126 attached to the bottommost ends of the top 102. The top 102 having lifting elements 104 secured thereto each of its corners.

In a preferred embodiment the rectangular modules 124 and the triangular modules 122 may include an interior and exterior covering. It may be suitable for the rectangular modules 124 and the triangular modules 122 to be covered by inside and outside after arranging them in the pyramid 100. In a preferred embodiment the outside of the rectangular modules 124 and the triangular modules 122 may be built in solar panels as illustrated in FIG. 2. The solar panels may be interconnected to transform solar energy to electric energy and thermal energy that can be used in the pyramid 100. It also may be suitable for the rectangular modules 124 and the triangular modules 122 to be covered from outside by metal, plastic, wood, concrete, or any other suitable material. The inside of the rectangular panels 124 and the inside of the triangular panels 122 may be covered by decorative panels, or any other suitable element. The decorative panels may be wood panels, MDF panels, glass and mirror panels or any other suitable decorative panel. It also may be suitable for the inside of the rectangular panels 124 and the inside of the triangular panels 122 to have noise and heat insulation.

Rectangular modules 124 and triangular modules 122 may be arranged together to create the four faces of tiers 126. The third step 40 may be attaching the tiers 126 to the bottommost end of a previous tier of the tiers 126 or the top 124. It should be understood that a first tier may be attached to the top 102 and then additional tiers 126 may be added to a previous tier of the tiers 126. Tiers 126 may be attached to previous tiers 126 or to the top 102 through mounting elements 127. The mounting elements 127 may connect the bottom and top of the tiers 126 to modulate the height of the pyramid. 100. A first tier of the tiers 126 may be attached to the bottommost end of the top 102. In a preferred embodiment the mounting elements 127 are hinges which allows pivoting a tier of the tiers 126 with respect to other tiers 126. It also may be suitable for the mounting elements 127 to be nuts and bolts, screws, or any other suitable mounting element.

A fourth step 50 may include lifting the top 102 or a tier of the tiers 126 and rearranging the lifting elements 104. In a preferred embodiment for adding a first tier of the tiers 126 the lifting elements 104 may be located on the four corners of the bottommost end of the top 102. Thus, the top 102 may be lifted and the first tier of the tiers 126 may be coupled beneath the top 102 defining a pyramid 100. The lifting elements 104 may be rearranged to the bottommost end of the first tier of the tiers 126 if a second tier is needed. The lifting elements 104 may lift then a first level, be rearranged to the bottommost end of a second tier to add a third tier of the tiers 126 if additional tiers 126 are needed, and so on. In a preferred embodiment the mounting elements 127 of the added tiers may be removed after arranging the tiers 126.

A fifth step 60 may be checking if more tiers 126 are needed. If more tiers are needed the method 10 may return to the second step 30. A new arrangement of rectangular modules 124 and triangular modules 122 may be made. This new arrangement is larger in length than the first tier of the tiers 126. The new tier of the tiers 126 may be added to the first tier and lifted. The lifting elements 104 may be rearranged to the bottommost end of said new tier of the tiers 126 as needed. Method 10 may repeat from the second step 30 to the fifth step 60 if additional tiers 126 are needed. If no additional tiers 126 are needed the lifting elements 104 may be removed.

The sixth step 70 may be removing the lifting elements 104 and the mounting elements 127. It may be suitable to use the mounting elements 127 to be used for adding any of the tiers 126 and be removed after placing the tiers 126 in a final position. It may be suitable for the pyramid 100 to include a water harvesting system. The mounting elements 127 are placed in an outer side of the triangular modules 122 and in an outer side of the triangular modules 122 to mount tiers 126 to the pyramid 100. As illustrated in FIG. 2 the final position of tiers 126 may be set and the mounting elements 127 removed. It also may be suitable to locate the pyramid 100 over a strip of concrete or any other surface.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method for constructing a pyramid, comprising:

a. securing corners of a top to lifting elements, wherein said lifting elements are capable of lift said top;

b. arranging modules to create a tier;

c. attaching said tier to a bottommost end of a previous level, wherein said previous level is said top or tiers;

d. lifting the tier and rearranging said lifting elements on the corners of said tier; and e. removing the lifting elements and mounting elements.

2. The method for constructing a pyramid set forth in claim 1, wherein said top has a shape of a framed square pyramid.

3. The method for constructing a pyramid set forth in claim 1, wherein said lifting elements are jacks.

4. The method for constructing a pyramid set forth in claim 1, wherein said modules are rectangular-framed modules and right-triangular-framed modules.

5. The method for constructing a pyramid set forth in claim 4, wherein said rectangular-framed modules and said right-triangular-framed modules are connected together by means of attaching elements to create an arrange of modules, said arrange of modules conforms with the shape of an enlarged trapezoid.

6. The method for constructing a pyramid set forth in claim 5, wherein said tier is made of four of said arrangement of modules.

7. The method for constructing a pyramid set forth in claim 5, wherein said arrangement of modules is attached to a bottommost end of said previous level by means of mounting elements, said mounting elements are attached to an uppermost end of said arrangement of modules.

8. The method for constructing a pyramid set forth in claim 5, wherein said attaching elements are prongs and openings.

9. The method for constructing a pyramid set forth in claim 1, wherein size of said pyramid is modular by adding or removing additional tiers.

10. The method for constructing a pyramid set forth in claim 1, wherein said lifting elements lift a level to add additional tiers.

11. The method for constructing a pyramid set forth in claim 1, wherein an outside of said modules and an outside of said top are covered by solar panels.

12. The method for constructing a pyramid set forth in claim 11, wherein said solar panels are interconnected to harvest solar power and convert said solar power into electric energy or thermal energy.

13. The method for constructing a pyramid set forth in claim 1, wherein an inside of said modules and an inside of said top are covered by decorative panels.

14. The method for constructing a pyramid set forth in claim 13, wherein said inside of said modules and said inside of said top include heat and noise insulation.

15. A method for constructing a pyramid, comprising:

a. securing corners of a top to lifting elements, wherein said lifting elements are capable of lifting said top, said top has a shape of a framed square pyramid;

b. arranging modules to create a tier, said modules are connected together by means of attaching elements to create an arrange of modules, said arrange of modules conforms with a shape of an enlarged trapezoid, said attaching elements are prongs and openings, said tier consists of four of said arrange of modules;

c. attaching an uppermost end of said tier to a bottommost end of a previous level, wherein said previous level is said top or tiers;

d. lifting said tier and rearranging said lifting elements on the corners of said tier, wherein_a size of said pyramid is modular by adding or removing said tiers, said lifting elements lift said previous level to add said tiers; and e. removing the lifting elements and mounting elements.

16. A method for constructing a pyramid, consisting of:

a. securing corners of a top to lifting elements, wherein said lifting elements are capable of lifting said top, said top has a shape of a framed square pyramid, said lifting elements are jacks;

b. arranging modules to create a tier, said modules are rectangular-framed modules and right-triangular-framed modules, said rectangular-framed modules and said right-triangular-framed modules are connected together by means of attaching elements to create an arrange of modules, said arrange of modules conforms with a shape of an enlarged trapezoid, said attaching elements are prongs and openings, said tier consists of four of said arrange of modules, said rectangular-framed modules and said right-triangular modules are covered by inside and outside, wherein said outside of said modules and an outside of said top are covered by solar panels, said solar panels are interconnected to harvest solar power and convert said solar power into electric energy and thermal energy, said inside of said modules and an inside of said top are covered by decorative panels, said inside of said modules and said inside of said top include heat and noise insulation;

c. attaching an uppermost end of said tier to bottommost end of a previous level, wherein said previous level is said top or said tier;

d. lifting said tier and rearranging said lifting elements on corners of said tier, wherein a size of said pyramid is modular by adding or removing tiers, said lifting elements lift said level to add said tiers; and e. removing the lifting elements and mounting elements.

* * * * *